US010010232B2

(12) United States Patent
Heinzer

(10) Patent No.: US 10,010,232 B2
(45) Date of Patent: Jul. 3, 2018

(54) DEVICE FOR WASHING FLOORS

(71) Applicant: SBD SUPERIOR BUSINESS DEVELOPMENT AG, Einsiedeln (CH)

(72) Inventor: Veit Michael Heinzer, Bassano Del Grappa (IT)

(73) Assignee: SBD SUPERIOR BUSINESS DEVELOPMENT AG, Einsiedeln (CH)

( * ) Notice: Subject to any disclaimer, the term of this patent is extended or adjusted under 35 U.S.C. 154(b) by 370 days.

(21) Appl. No.: 14/902,186

(22) PCT Filed: Jul. 1, 2014

(86) PCT No.: PCT/EP2014/063919
§ 371 (c)(1),
(2) Date: Dec. 30, 2015

(87) PCT Pub. No.: WO2015/000878
PCT Pub. Date: Jan. 8, 2015

(65) Prior Publication Data

US 2016/0309978 A1 Oct. 27, 2016

(30) Foreign Application Priority Data

Jul. 2, 2013 (IT) ..... VR2013A0153

(51) Int. Cl.
*A47L 13/14* (2006.01)
*A47L 13/256* (2006.01)
*A47L 13/142* (2006.01)

(52) U.S. Cl.
CPC ..... *A47L 13/142* (2013.01); *A47L 13/14* (2013.01); *A47L 13/256* (2013.01)

(58) Field of Classification Search
CPC ..... A47L 13/142; A47L 13/14; A47L 13/256
(Continued)

(56) References Cited

U.S. PATENT DOCUMENTS 6,418,585 B1 * 7/2002 Viner ..... A47L 13/146 15/119.2
7,225,497 B1 * 6/2007 Ho ..... A47L 13/146 15/119.1
(Continued)

FOREIGN PATENT DOCUMENTS

DE 196 48 956 A1 6/1998
DE 10 2009 037 071 A1 2/2011
(Continued)

OTHER PUBLICATIONS

International Search Report dated Oct. 22, 2014 received from International Application No. PCT/EP2014/063919.

*Primary Examiner* — Weilun Lo
(74) *Attorney, Agent, or Firm* — Scully, Scott, Murphy & Presser, P.C.

(57) ABSTRACT

A device for washing floors, comprising a handle that can be gripped by a user and is connected to a supporting element for at least one washing cloth that has at least one working portion arranged on a respective plane of arrangement, the device comprising a wringing device that is mounted so that it can slide on the handle and supports at least one friction tooth intended to act on the washing cloth, with the device placed in the wringing and cleaning condition, as a consequence of a relative sliding motion of the wringing device with respect to the handle.

13 Claims, 5 Drawing Sheets

(58) Field of Classification Search
USPC ..... 15/116.1, 116.2, 119.1, 119.2
See application file for complete search history.

(56) References Cited

U.S. PATENT DOCUMENTS

| | | | | |
|---|---|---|---|---|
| 8,011,056 | B2 * | 9/2011 | Aldana | A46B 17/04 15/116.1 |
| 2002/0162573 | A1 * | 11/2002 | Fernandez | A47L 13/144 134/6 |
| 2002/0174501 | A1 * | 11/2002 | Specht | A47L 13/144 15/119.1 |
| 2004/0158947 | A1 * | 8/2004 | Sie | A47L 13/144 15/119.2 |
| 2005/0155171 | A1 * | 7/2005 | Boyer | A47L 13/146 15/119.2 |
| 2011/0209298 | A1 * | 9/2011 | Weaver | A47L 13/144 15/119.1 |
| 2012/0167320 | A1 * | 7/2012 | Weaver | A47L 13/144 15/119.1 |

FOREIGN PATENT DOCUMENTS

| | | | |
|---|---|---|---|
| DE | 10 2009 041 640 | A1 | 3/2011 |
| DE | 20 2011 005 690 | U1 | 10/2011 |
| FR | 2 982 757 | A1 | 5/2013 |
| WO | WO 2010/116089 | A1 | 10/2010 |

* cited by examiner

DEVICE FOR WASHING FLOORS

The present invention relates to a device for washing floors.

Several types of devices are known for washing floors.

One of the most practical and effective systems involves the use of a device that comprises a handle that can be gripped by the user and connected, at an end portion thereof, to a supporting element for a washing cloth made of microfiber or of other technofibers.

Typically, in order to wash the washing cloth, one immerses it in a bucket of water or of water and detergent and rubs it on a surface which is provided with a plurality of bars arranged at right angles to the direction of rubbing.

In this regard, a solution of this type is described in patent no. DE19648956 in the name of Mondotrade AG.

The solution described above, although highly valid from a conceptual point of view, suffers however a number of drawbacks.

In particular, it is necessary to use buckets of considerable size for the washing.

Furthermore, the surface that supports the bars extends above the access mouth of the bucket and this limits and renders difficult the operations to insert and withdraw the cloth to be washed into and out of the bucket.

The aim of the present invention is provide a device for washing floors which is capable of reducing, or at least drastically limiting, the above mentioned drawbacks.

Within this aim, an object of the present invention is to make available a device for washing floors which is extremely practical to use.

Another object of the present invention is to devise a device for washing floors which allows great flexibility of use.

This aim and these and other objects which will become better apparent hereinafter are all achieved by a device for washing floors according to claim 1.

Further characteristics and advantages of the invention will become better apparent from the description of some preferred but not exclusive embodiments of a device for washing floors, which are illustrated by way of non-limiting example in the accompanying drawings wherein.

Figure 1:
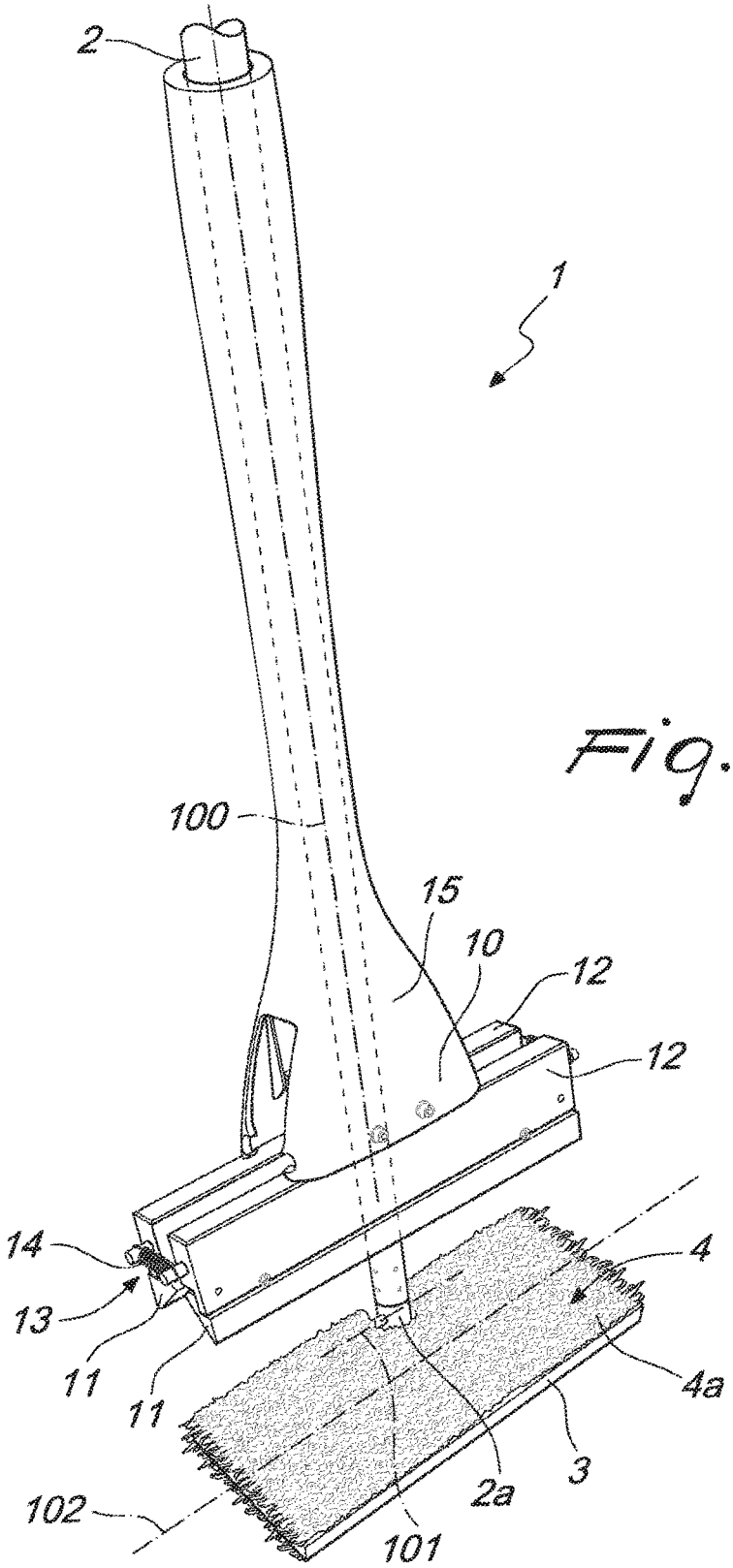
FIG. 1 is a perspective view of a device for washing floors in the condition for use according to the invention.

In the embodiments illustrated, individual characteristics shown in relation to specific examples may in reality be interchanged with other, different characteristics, existing in other embodiments.

With reference to the figures, the present invention relates to a device, for washing floors, generally indicated with the reference numeral 1.

The device 1 comprises a handle 2 that can be gripped by the user and is connected, at an end portion 2*a*, to a supporting element 3 for at least one washing cloth 4.

The washing cloth 4 has at least one working portion 4*a*, which is arranged on a respective plane of arrangement.

Figure 2:
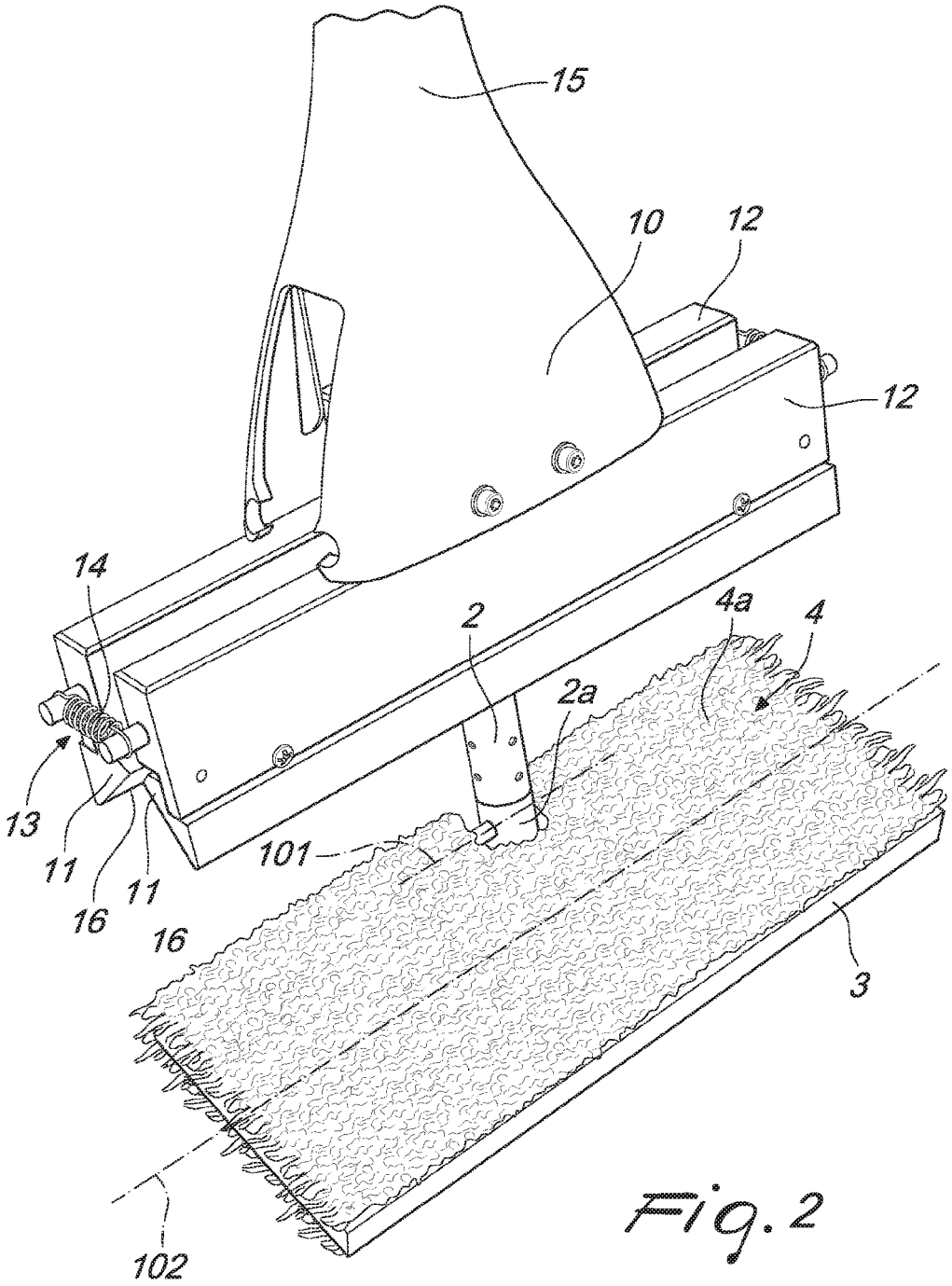
FIG. 2 is an enlarged view of the portion of the device in contact with the floor.
Figure 3:
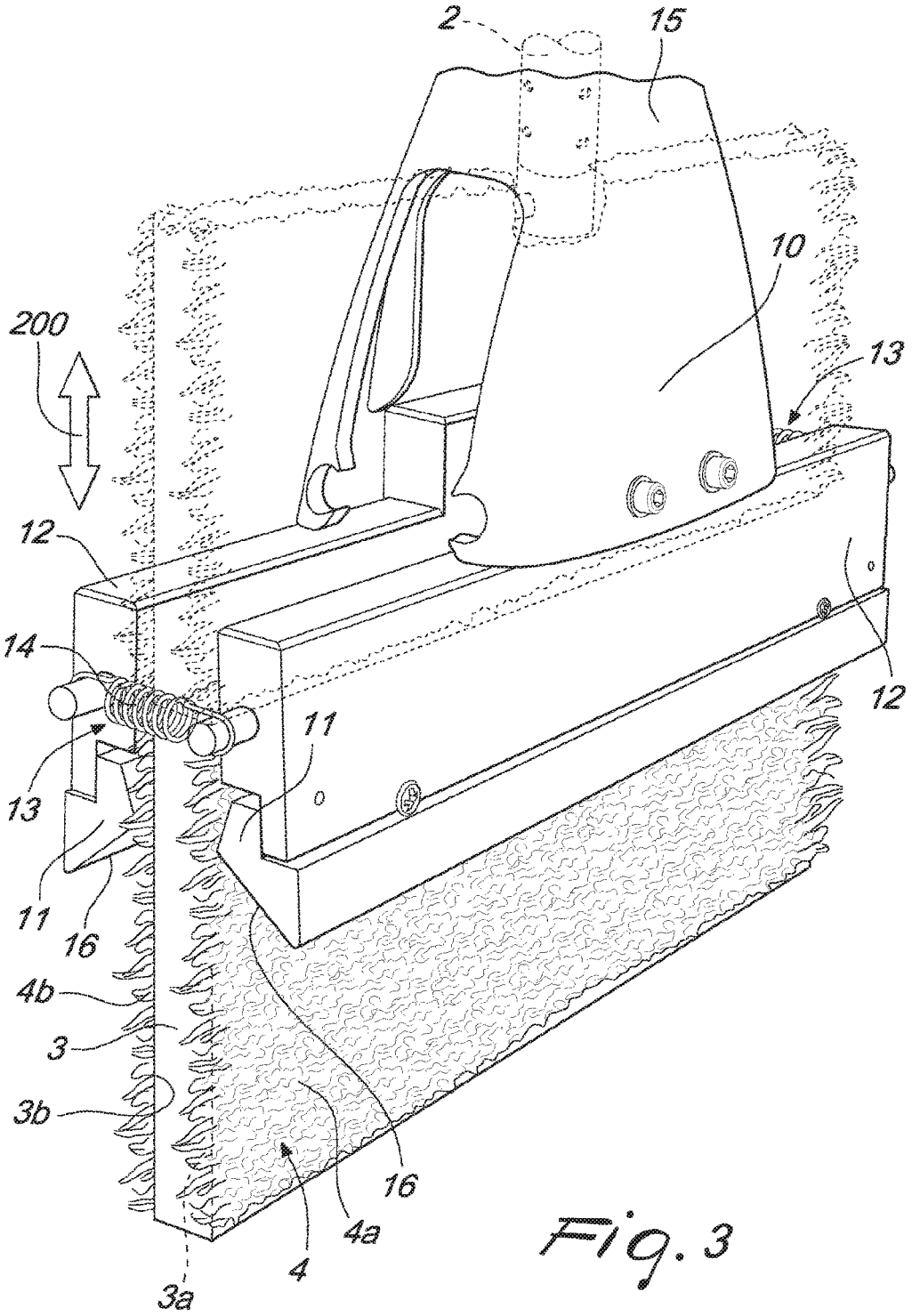
FIG. 3 is a perspective view of the device during the condition for wringing and cleaning the cloth.

The device 1 is adapted to pass between a condition for use (shown in FIGS. 1, 2 and 4) in which the longitudinal axis 100 of the handle 2 is incident to the plane of arrangement of the working portion 4*a* of the washing cloth 4, and a condition of wringing and cleaning the cloth 4 (shown in FIGS. 3 and 5) in which the washing cloth 4 is arranged with at least one plane of arrangement substantially parallel to the longitudinal axis 100 of the handle 2.

According to the present invention, the device 1 comprises a wringing device 10 mounted so that it can slide on the handle 2.

The wringing device 10 supports at least one friction tooth 11, which is designed to act on the washing cloth 4, with the device 1 placed in the wringing and cleaning condition, as a consequence of a relative sliding motion of the wringing device 10 with respect to the handle 2.

The supporting element 3 has an elongated shape structure that is substantially parallel to a main longitudinal direction 102.

In the condition for wringing and cleaning, the main longitudinal direction 102 of the supporting element 3 is arranged substantially at right angles to the longitudinal axis 100 of the handle 2.

According to a preferred embodiment, the wringing device 10 can slide with respect to the handle 2 along a movement direction, indicated with the arrow 200, which is substantially parallel to the longitudinal axis 100 of the handle 2.

It is possible for the end portion 2*a* of the handle 2 to be rotatable, about a pivoting axis 101, with respect to the supporting element 3.

With reference to the embodiment illustrated in FIGS. 1-5, the movement direction 200 is substantially perpendicular to the pivoting axis 101.

In fact, the transition of the device 1 from the condition for use to the condition for wringing and cleaning the cloth 4 occurs by way of raising the handle 2, which causes the oscillation of the supporting element 3 about the pivoting axis 101 and the arrangement, by gravity, of the working portion 4*a*, 4*b* on a substantially vertical plane.

Advantageously, the pivoting axis 101 is arranged substantially parallel to the main longitudinal direction 102 of the supporting element 3.

This, evidently, makes it possible for the sliding of the wringing device 10 with respect to the handle 2 to determine the automatic transition of the device 1 from the condition for use to the condition for wringing and cleaning the cloth 4, and vice versa.

Advantageously, the washing cloth 4 comprises a cloth made of microfiber or of other technofibers.

With reference to the embodiment shown in the figures, the supporting element 3 defines two substantially flat mutually opposite surfaces 3*a*, 3*b* which are associated with a respective working portion 4*a*, 4*b* of the washing cloth 4.

The surfaces 3*a*, 3*b* are mutually opposite with respect to the plane of arrangement of the supporting element 3. As a consequence, the surfaces 3*a* and 3*b* are mutually opposite in the condition for use as well.

It is possible for the two working portions 4*a*, 4*b* to be defined on the same washing cloth 4.

The washing cloth 4 can be associated detachably with the supporting element 3, for example by way of strips of Velcro® or by way of elastic bands or retaining teeth.

With reference to the embodiment that has the two working portions 4*a*, 4*b*, it is possible for the wringing device 10 to support at least two friction teeth 11 which are designed to act on a respective working portion 4*a*, 4*b*.

For certain particular conditions of use, the two working portions 4*a* and 4*b* can have different technical washing characteristics.

The wringing device 10 comprises a supporting body 12 for the friction tooth or teeth 11.

The supporting body 12 can be constituted by a pair of elongated bodies, which are arranged on opposite sides with respect to the longitudinal axis 100 of the handle 2 and which support at least one respective friction tooth 11.

The elongated bodies are likewise connected to a maneuvering portion 15, which is substantially tubular and is fitted around a portion of the handle 2.

The supporting body or bodies 12 are associated with elastic loading means 13 that act, when the device 1 is placed in the condition for wringing and washing the cloth 4, between the working portion 4*a*, 4*b* and the respective friction tooth 11.

In particular, the elastic loading means 13 are adapted to keep, during the condition for wringing and washing the cloth 4, the (or each) tooth 11 pressed against the respective working portion 4*a*, 4*b*.

Advantageously, the washing cloth 4 comprises a plate-like element made of waterproof material which is arranged so as to face the supporting element 3.

Such choice makes it possible to render the action of the friction tooth or teeth 11 against the working portion 4*a*, 4*b* extremely effective, thus preventing, in fact, the wrung-out water from passing through the working portion 4*a*, 4*b*.

Conveniently, the wringing device 10 comprises, at the region that, in the condition for use, is directed toward the supporting element 3, an inclined guiding surface 16 that is adapted to facilitate, during the transition of the device 1 from the condition for use to the condition for wringing and cleaning the cloth 4, the rotation of the supporting element 3 in order to place the working portion or portions 4*a*, 4*b* on a plane of arrangement that is parallel to the longitudinal axis 100 of the handle 2.

Figures 4, 6:
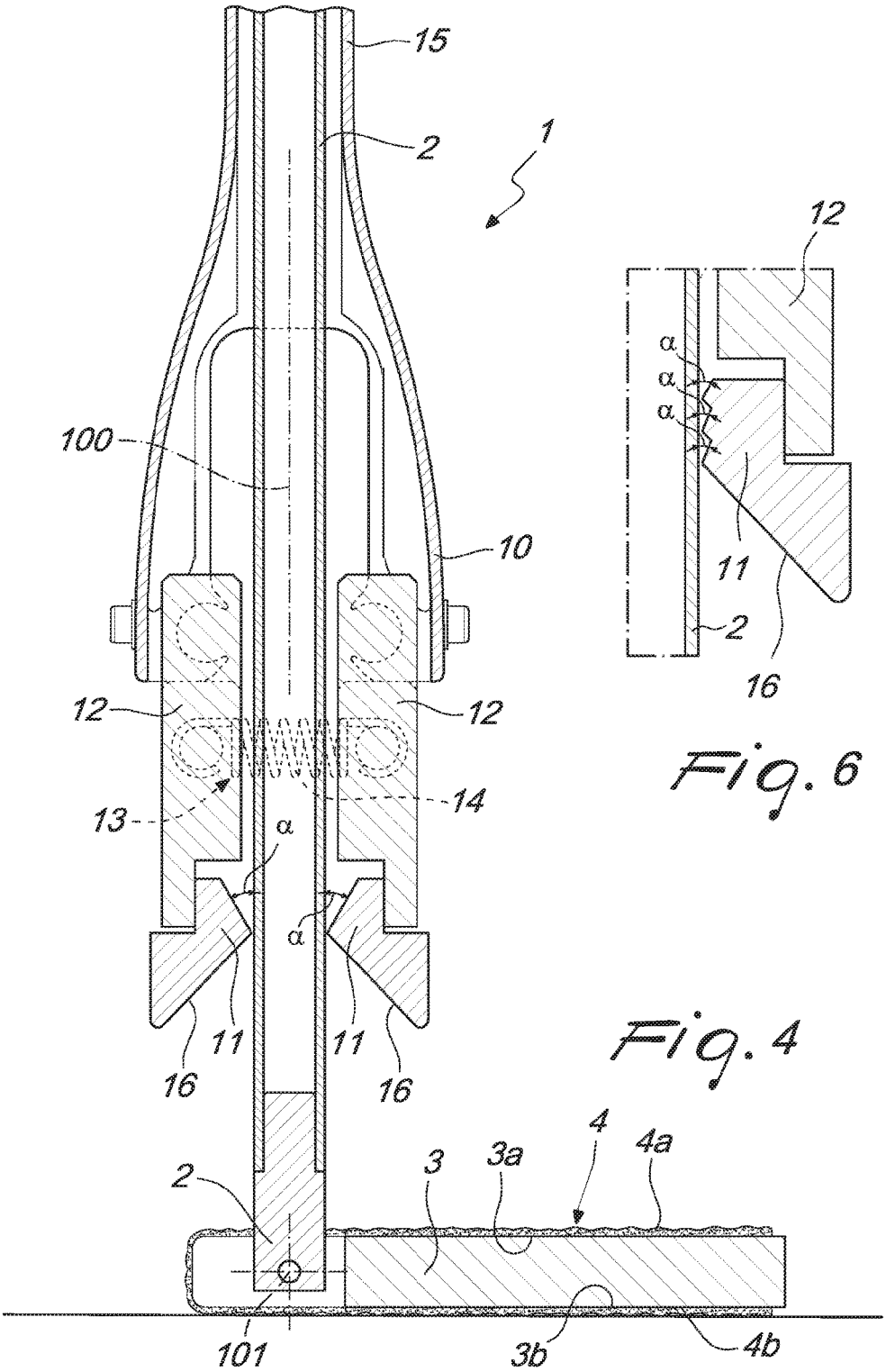
FIG. 4 is a longitudinal cross-sectional view of the device for washing floors in the condition for use.
FIG. 6 is an enlarged cross-sectional view of a variation of embodiment of the wringing device.
Figure 5:
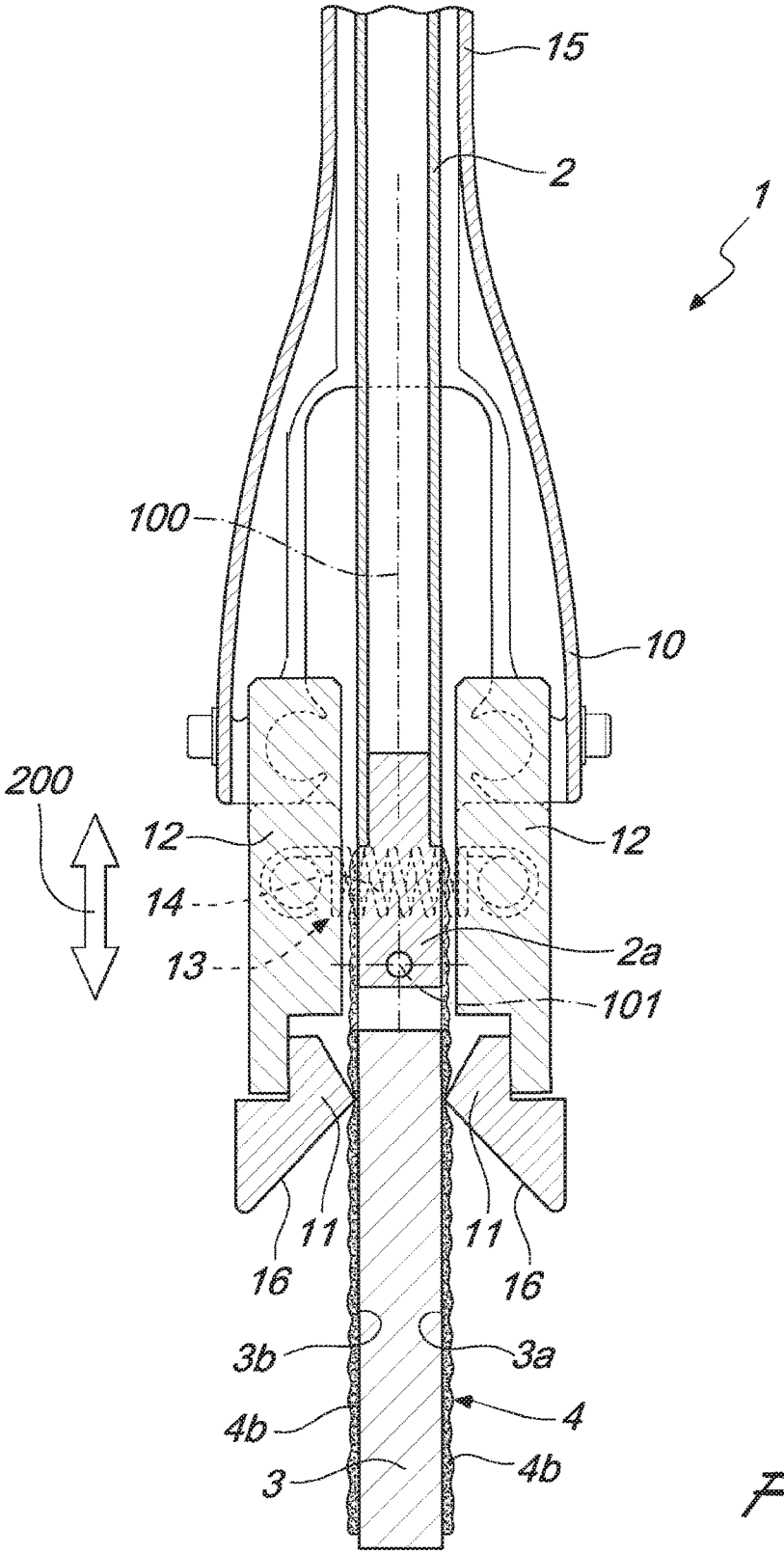
FIG. 5 is a cross-sectional view similar to the previous view of the device for washing floors in the condition for wringing and cleaning the cloth.

With reference to the variation of embodiment shown in FIG. 6, it is possible for the wringing device 10 to support, on one or on both sides, two or more friction teeth 11 mutually spaced along a direction that is parallel to the longitudinal axis 100 of the handle 2.

It has been found to be extremely advantageous to have at least one angle of incidence, indicated with $\alpha$, defined between one side of the tooth 11 and the plane of arrangement of the respective working portion 4*a* be smaller than 45° and, preferably, comprised between 25° and 35°.

Conveniently, the angle $\alpha$ is the angle directed toward the handle 2.

The use of a device 1 for cleaning floors according to the present invention is evident from the foregoing description.

In particular, in the condition for use, the device 1 is gripped by the user by way of the handle 2 and the washing cloth 4, which is supported by the supporting element 3 that is pivoted to the end portion 2*a* of the handle 2, is pushed by the handle 2 which has its longitudinal axis 100 incident to the plane of arrangement of the working portion 4*b*.

If the device 1 is to be placed in the condition for wringing and cleaning the washing cloth 4, the user lifts the handle 2, bringing it, conveniently, to a vertical direction, and the wringing device 10 is moved slideably, with respect to the handle 2, by acting on the maneuvering portion 15.

In this manner, the friction tooth or teeth 11, which extend substantially at right angles to the movement direction 200, rub on the respective working portion 4*a* and 4*b* thus causing the cleaning of the washing cloth 4.

In practice it has been found that in all the embodiments the invention has achieved the intended aim and objects.

In practice the materials employed, as well as the dimensions and the contingent shapes, may be any according to requirements.

Moreover, all the details may be substituted by other, technically equivalent elements.

The disclosures in Italian Patent Application No. VR2013A000153 from which this application claims priority are incorporated herein by reference.

Where the technical features mentioned in any claim are followed by reference numerals and/or signs, those reference numerals and/or signs have been included for the sole purpose of increasing the intelligibility of the claims and accordingly, such reference numerals and/or signs do not have any limiting effect on the interpretation of each element identified by way of example by such reference numerals and/or signs.

The invention claimed is:

1. A device for washing floors, comprising a handle that can be gripped by a user and is connected, at an end portion thereof, to a supporting element for at least one washing cloth that has at least one working portion arranged on a respective plane of arrangement, said device being adapted to pass between a condition for use, in which the longitudinal axis of said handle is incident to the plane of arrangement of said at least one working portion of said washing cloth, and a condition for wringing and cleaning said washing cloth, in which said washing cloth is arranged with said at least one plane of arrangement substantially parallel to the longitudinal axis of said handle and further comprising a wringing device that is mounted so that it can slide on said handle and supports at least one friction tooth intended to act on said washing cloth, with said device placed in said wringing and cleaning condition, as a consequence of a relative sliding motion of said wringing device with respect to said handle, said supporting element having an elongated shape structure that is substantially parallel to a main longitudinal direction, in said wringing and cleaning condition said main longitudinal direction being arranged substantially perpendicular to the longitudinal axis of said handle.

2. The device according to claim 1, wherein said wringing device can slide with respect to said handle along a movement direction that is substantially parallel to the longitudinal axis of said handle.

3. The device according to claim 1, wherein said washing cloth comprises a cloth made of microfiber or similar technofibers.

4. The device according to claim 1, wherein said supporting element defines, in the condition for use, two substantially flat mutually opposite surfaces which are associated with a respective working portion.

5. The device according to claim 4, wherein said two working portions are defined on the same washing cloth.

6. The device according to claim 4, wherein said wringing device supports at least two friction teeth intended to act on a respective working portion.

7. The device according to claim 4, wherein said two working portions have different technical washing characteristics.

8. The device according to claim 1, wherein said wringing device comprises a supporting body for said at least one friction tooth, elastic loading means being provided which act, with said device in said wringing condition, between said working portion and the respective friction tooth and are adapted to keep, during the wringing condition, said tooth pressed against the respective working portion.

9. The device according to claim 1, wherein said washing cloth comprises a plate-like element made of waterproof material arranged so as to face said supporting element.

10. The device according to claim 1, wherein said wringing device comprises, at a region that in the condition for use is directed toward said supporting element, an inclined guiding surface that is adapted to facilitate, during a transition of the device from said condition for use to said wringing condition, the rotation of said supporting element in order to place said at least one working portion on a plane of arrangement that is parallel to said longitudinal axis of said handle.

11. The device according to claim 1, wherein said end portion of said handle can rotate, about a pivoting axis, with respect to said supporting element.

12. The device according to claim 1, wherein said wringing device supports two or more friction teeth, which are mutually spaced along a direction that is parallel to the longitudinal axis of said handle.

13. The device according to claim 4, wherein said at least one friction tooth has at least one angle of incidence defined between one side of the tooth and the plane of arrangement of the respective working portion that is smaller than 45° and preferably comprised between 25° and 35°.

* * * * *